US006623275B1

(12) United States Patent
Pavlovic et al.

(10) Patent No.: US 6,623,275 B1
(45) Date of Patent: Sep. 23, 2003

(54) FILTERED ELECTRICAL CONNECTOR WITH ADJUSTABLE PERFORMANCE USING COMBINED MULTI-APERTURE FERRITE CORES

(75) Inventors: Slobodan Pavlovic, Canton, MI (US); Gerhard Drescher, Canton, MI (US); Eric Torrey, Ypsilanti, MI (US)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 10/183,359

(22) Filed: Jun. 28, 2002

(51) Int. Cl.[7] ..... H01R 11/30; H01R 13/60
(52) U.S. Cl. ..... 439/38; 439/620
(58) Field of Search ..... 439/38, 620, 40

(56) References Cited

U.S. PATENT DOCUMENTS 4,306,499 A * 12/1981 Holmes ..... 102/202.4
5,182,427 A * 1/1993 McGaffigan ..... 219/663
5,286,221 A * 2/1994 Fencl et al. ..... 439/607
6,086,422 A * 7/2000 Glynn ..... 439/620
6,250,952 B1 * 6/2001 Shiga et al. ..... 439/466
6,375,510 B2 * 4/2002 Asao ..... 439/620
6,461,184 B2 * 10/2002 Nimura ..... 439/352
2001/0055921 A1 * 12/2001 Kuhnel ..... 439/877
2001/0055922 A1 * 12/2001 Kuhnel ..... 439/877

* cited by examiner

*Primary Examiner*—Lynn Feild
*Assistant Examiner*—Hae Moon Hyeon
(74) *Attorney, Agent, or Firm*—Blank Rome LLP

(57) ABSTRACT

A filtered electrical connector with adjustable performance using combined multi-aperture ferrite cores is disclosed. More particularly, the filtered electrical connector includes a connector housing made of an electrically insulating material, at least two terminals each having a cable contact area for conductively attaching cables for conducting a signal to be filtered and a contacting portion for making contact with a corresponding contacting portion in a complementary mating connector. The filtered electrical connector further includes a filter assembly which in turn includes an electrical conductor for conducting an electrical signal to be filtered and at least two ferrite bodies. Each of the ferrite bodies includes at least two passages therein with the electrical conductor passing through the passages. The respective ends of the electrical connector are connected in series between one of the cable contact areas and an associated contacting portion.

15 Claims, 10 Drawing Sheets

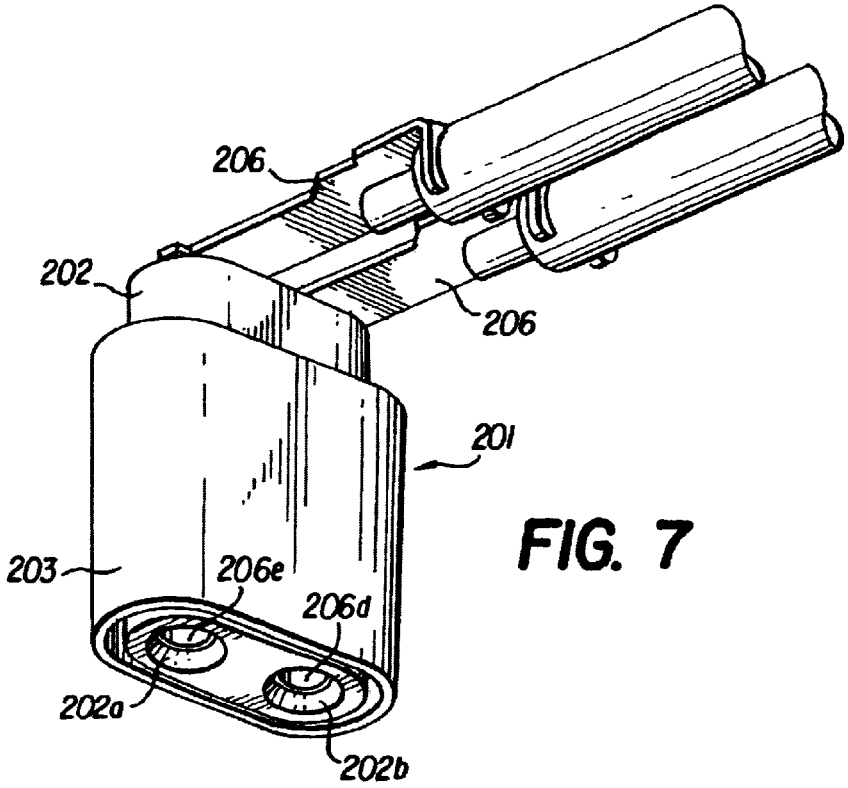
FIG. 7
FIG. 9
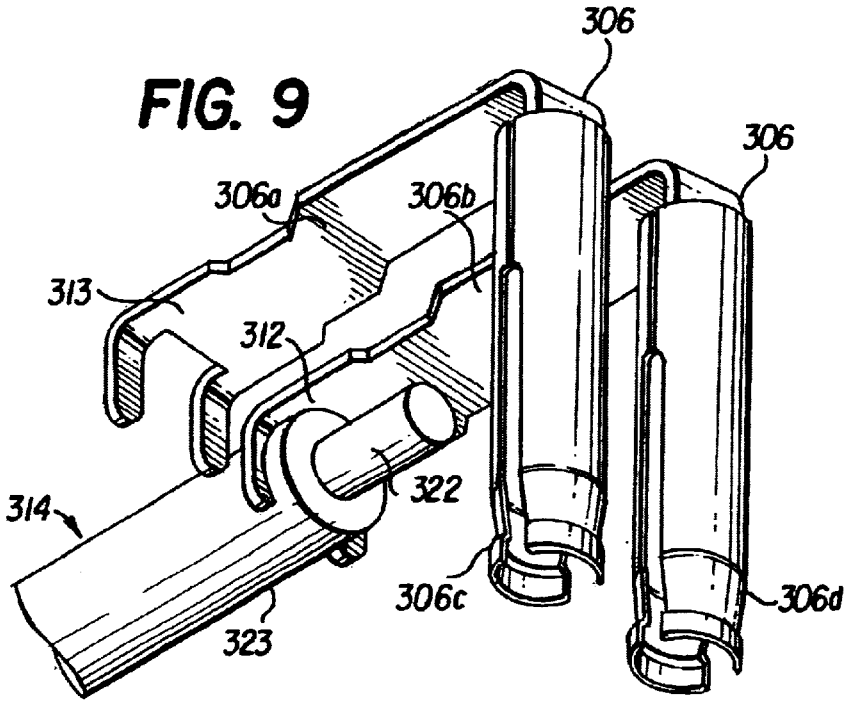

FILTERED ELECTRICAL CONNECTOR WITH ADJUSTABLE PERFORMANCE USING COMBINED MULTI-APERTURE FERRITE CORES

The present invention relates to a filter assembly for filtering of electrical signals, and to a filtered electrical connector including such a filter assembly. In particular, the present invention relates to a filtered electrical connector with adjustable performance using combined multi-aperture ferrite cores.

BACKGROUND OF THE INVENTION

Filtered electrical connectors are known. Conventional filtered electrical connectors use a ferrite bead or a coil, or both, for attenuating and filtering electrical signals directed through the electrical connector. Coils provide filtering functions which show very distinct peaks of attenuation at certain (resonance) frequencies while the filtering performance between the peaks is poor. Ferrite beads provide a more uniform attenuation over the frequency spectrum but still show better filtering performance in certain frequency ranges than in others.

A particularly important application for filtered electrical connectors are connectors for connecting vehicle control electronics with a squib or igniter of an air bag device. An electrical deployment signal is directed through the connector for actuating the air bag device. In absence of the deployment signal, it must be made sure that the air bag device in not inadvertently deployed by induced signals. Such signals may be induced, for example, by mobile telephones which transmit signals at particular frequencies such as 900 MHz, 1.8 or 1.9 GHz. Of course, in today's environment filled with electronics, signals at many different frequencies may be induced and might cause actuation of the air bag device.

Another important consideration are spatial constraints. Miniaturization is an important trend in industry, and it is particularly important for connectors for air bag devices which are built into various places in automobiles where there is little space available such as the steering wheel, seat portions, or structural portions of the vehicle.

It is thus an important object of the invention to overcome one or more of the problems associated with prior art filter assembly or filtered electrical connectors.

Another object of the invention is to improve the filtering performance of filtered electrical connectors without substantially adding to the size and cost of the connector.

SUMMARY OF THE INVENTION

In order to attain the above objects, the present invention provides a filter assembly for filtering of electrical signals, comprising an electrical conductor for conducting an electrical signal to be filtered, at least two ferrite bodies, each of the ferrite bodies comprising at least two passages therein with the electrical conductor passing through said passages. Preferably, the filter assembly comprises two ferrite bodies, each having two passages therein. In a preferred embodiment, the ferrite bodies are of a generally cylindrical shape having a generally oval cross-section, wherein preferably the ferrite bodies are positioned adjacent to each other and the passages in the ferrite bodies are aligned in pairs. It is preferred that the passages are parallel to each other. Advantageously, the electrical conductor is passed through a first pair of the passages in a first direction and then through a second pair of said passages in a second direction opposite to said first direction. The ferrite bodies may be different in size, and/or may be made of materials with different filter performance.

According to another aspect of the invention, a filtered electrical connector is provided, comprising a connector housing made of an electrically insulating material, at least two terminals each having a cable contact area for conductively attaching cables for conducting a signal to be filtered and a contacting portion for making contact with a corresponding contacting portion in a complementary mating connector, and a filter assembly, comprising an electrical conductor for conducting an electrical signal to be filtered and at least two ferrite bodies, each of the ferrite bodies comprising at least two passages therein with the electrical conductor passing through the passages, with respective ends of the electrical connector being connected in series between one of the cable contact areas and an associated contacting portion. According to a preferred embodiment, the filtered electrical connector further comprises a frame made of electrically conductive material, said frame forming said at least two terminals. The filter assembly of the first aspect of the invention may be used in the filtered electrical connector of the second aspect of the invention. Preferably, the filtered electrical connector is an angled air bag connector.

This invention provides a combination of optimal filtering performance over a wide frequency range and small packaging size suitable in connector applications. Instead of one multiaperture core (connectors are commonly built with one material/one piece ferrite filter), this invention proposes a combination of ferrite filters consisting of two or more multiaperture cores using different ferrite materials and sizes to assure optimal filtering performance over a defined frequency range. The electrical signal is routed trough the ferrites using magnet wire. The magnet wire is resistance/sonically welded or soldered to the terminal frame. An advantage of this invention over prior art is superior filtering performance over a much wider frequency range in smallest possible packaging.

BRIEF DESCRIPTION OF THE DRAWINGS

The foregoing aspects and other features of the present invention are explained in the following description in combination with the accompanying drawings, in which:

FIG. 7 is a perspective schematic view of an alternative filter assembly, generally similar to the filter assembly of FIG. 4, including two concentrically arranged ferrite cores;

FIG. 9 is a perspective schematic view of the terminals of the filter assemblies of FIGS. 4–8 and show the terminal/ cable interface with partial IDC (insulation displacement connection) used as insulation strain relief;

Figure 5:
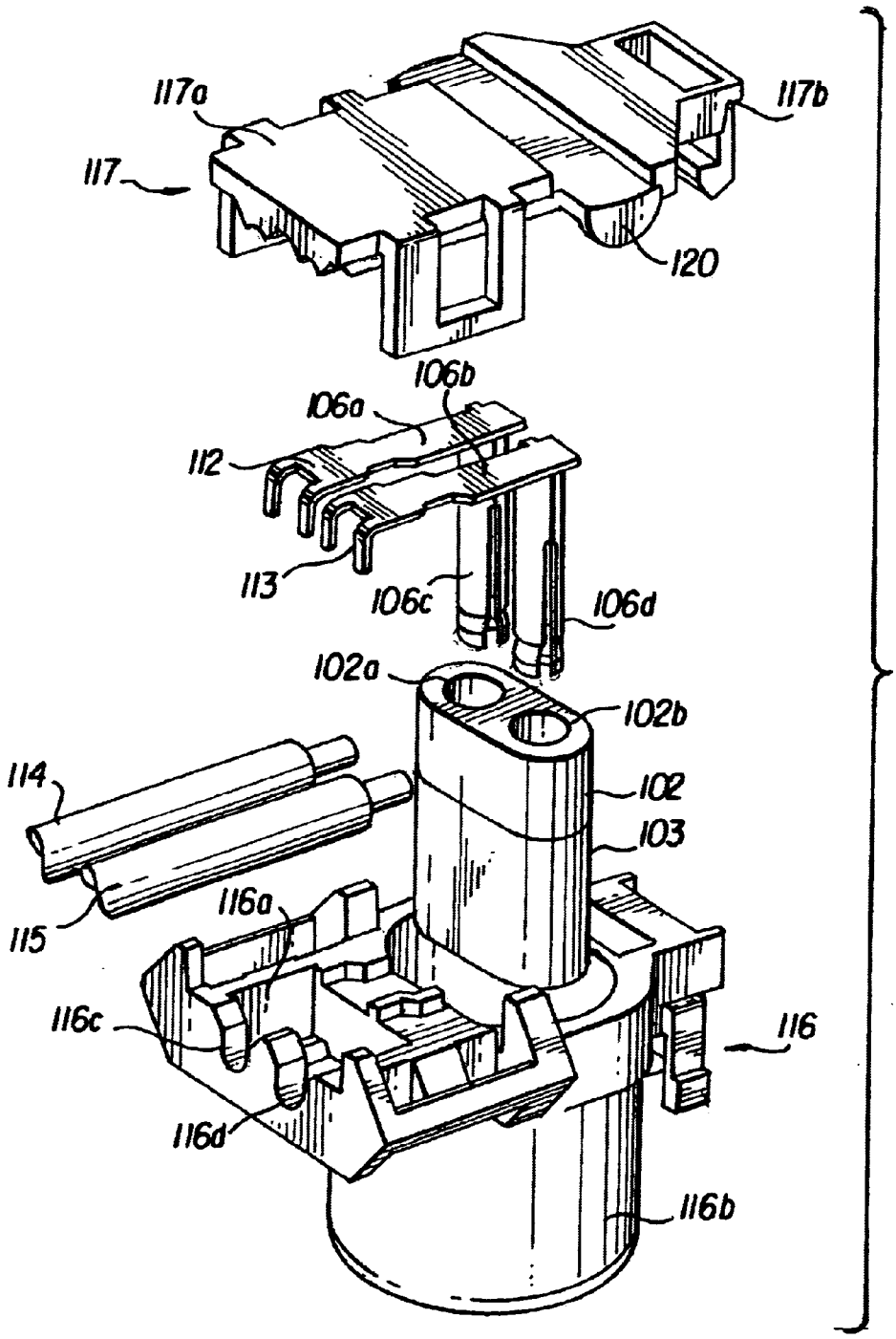
FIG. 5 is a schematic explosive view of an air bag connector including the filter assembly of FIG. 4.
Figure 6:
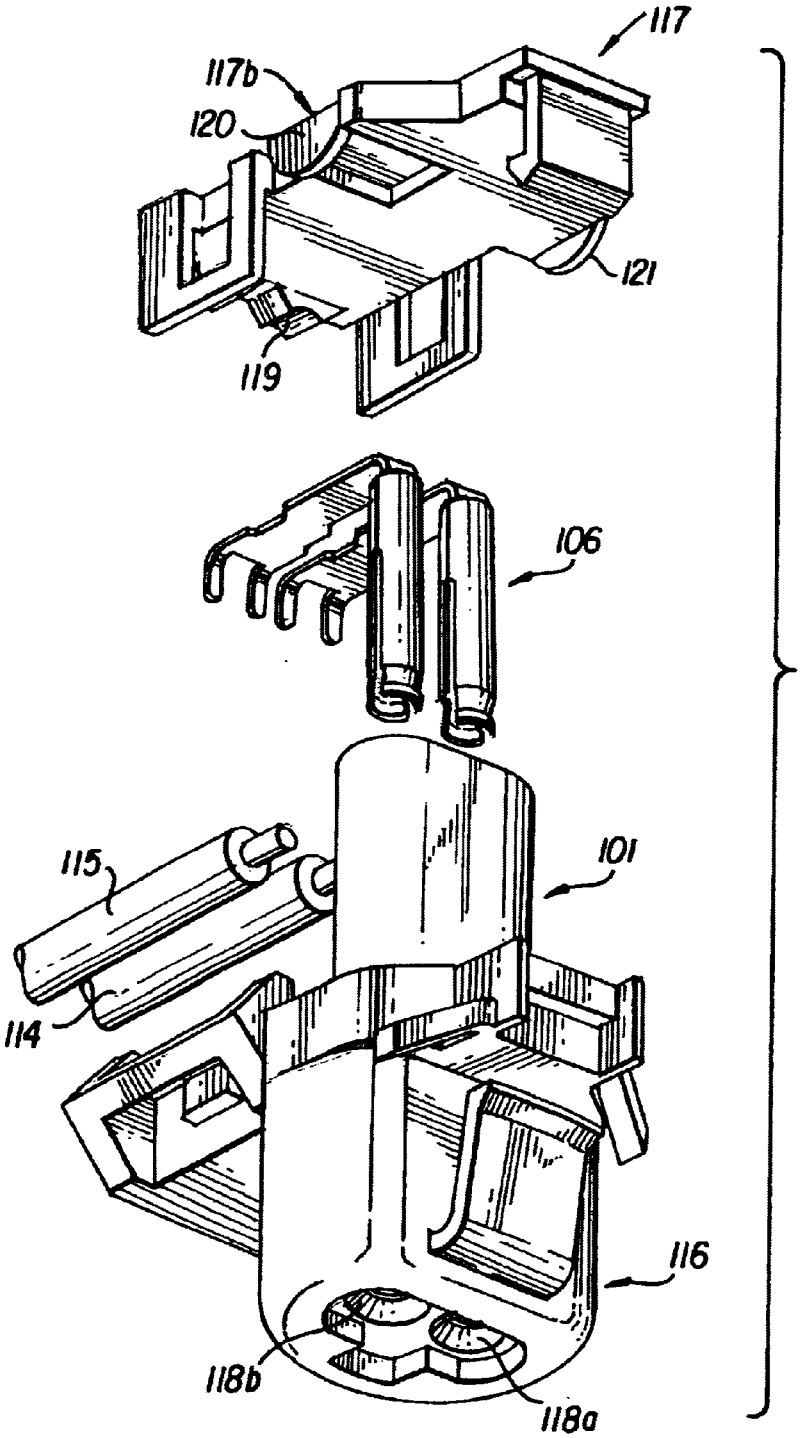
FIG. 6 is a schematic explosive view of the air bag connector of FIG. 5 from a different perspective.
Figure 10:
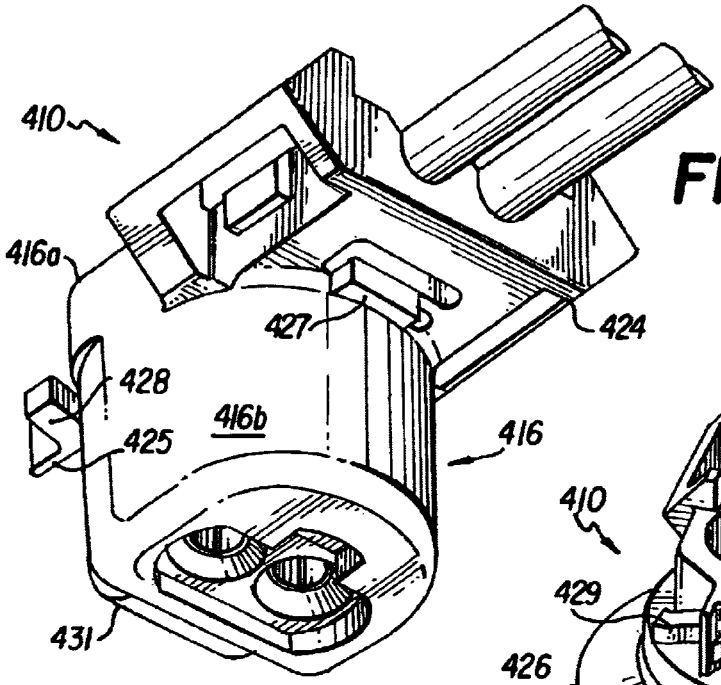
Figure 11:
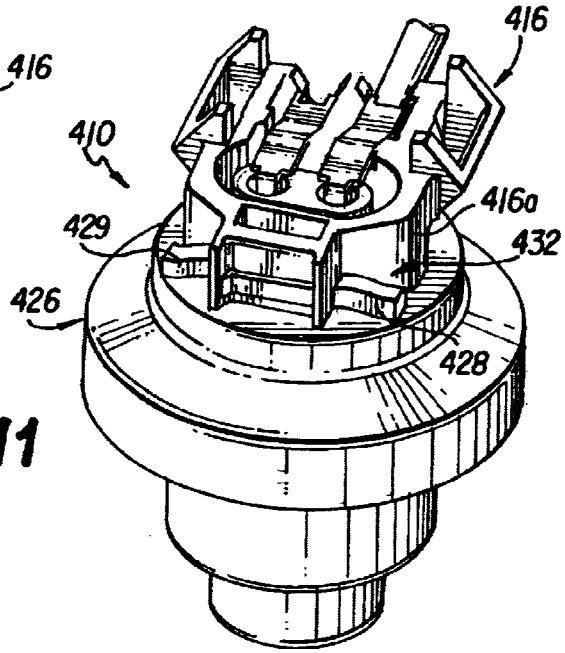
Figure 12:
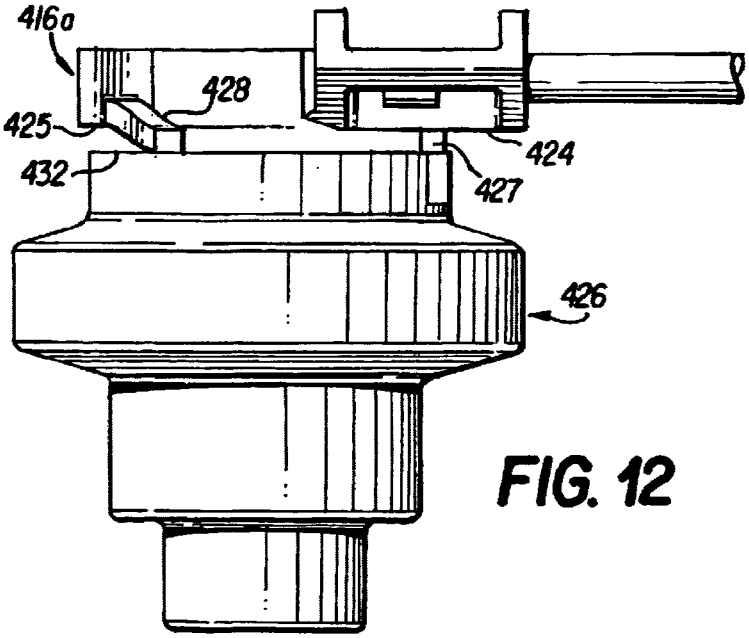
Figure 13:
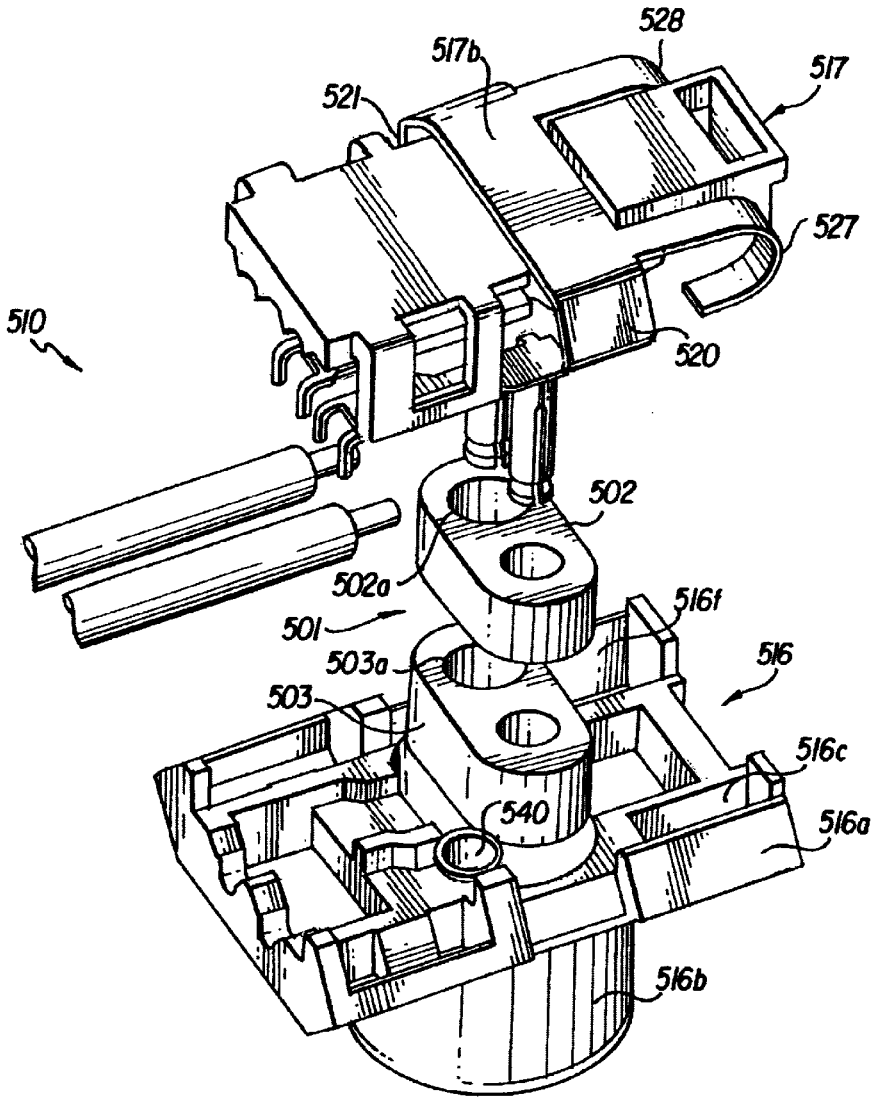
Figure 14:
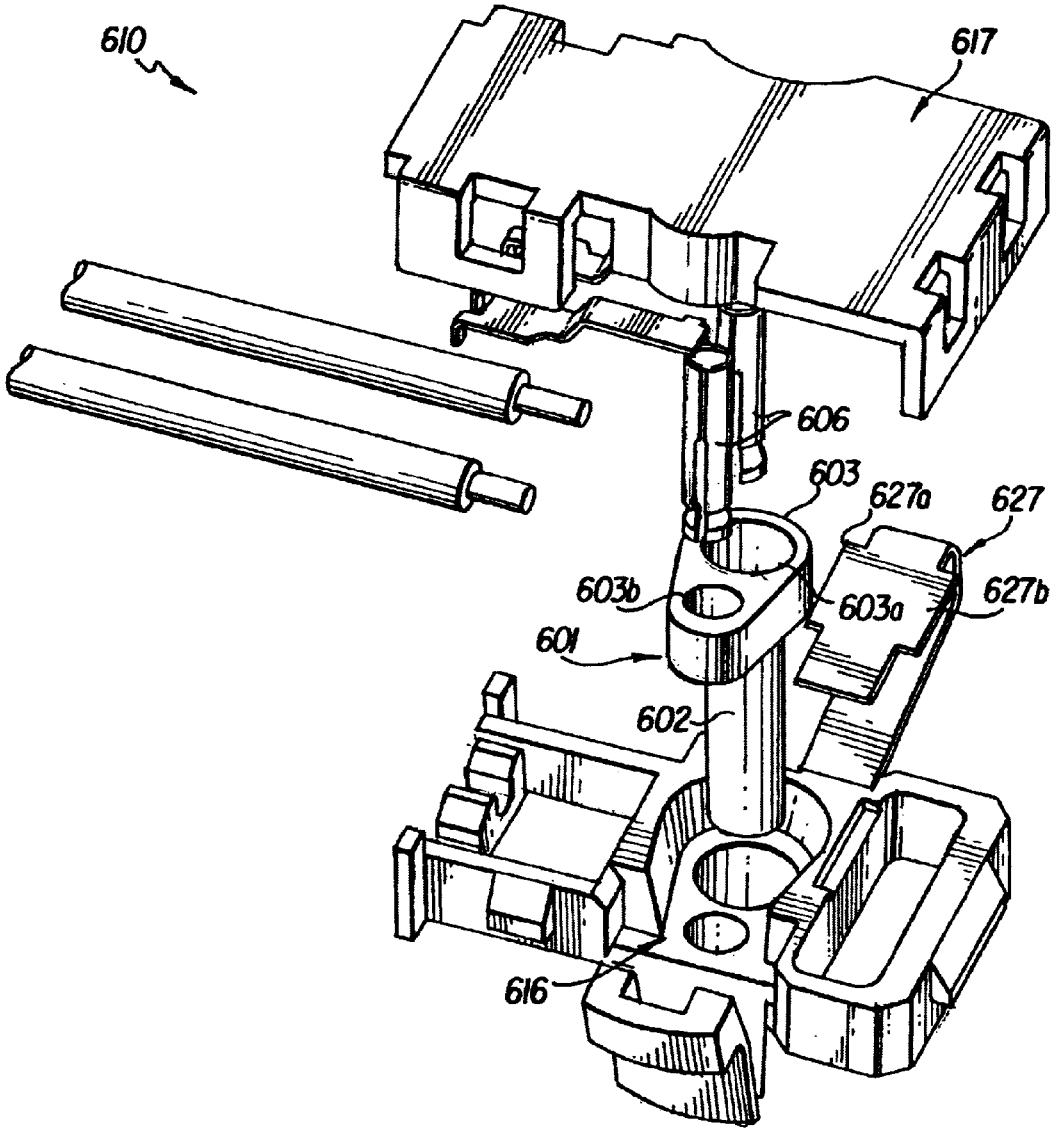
Figure 15:
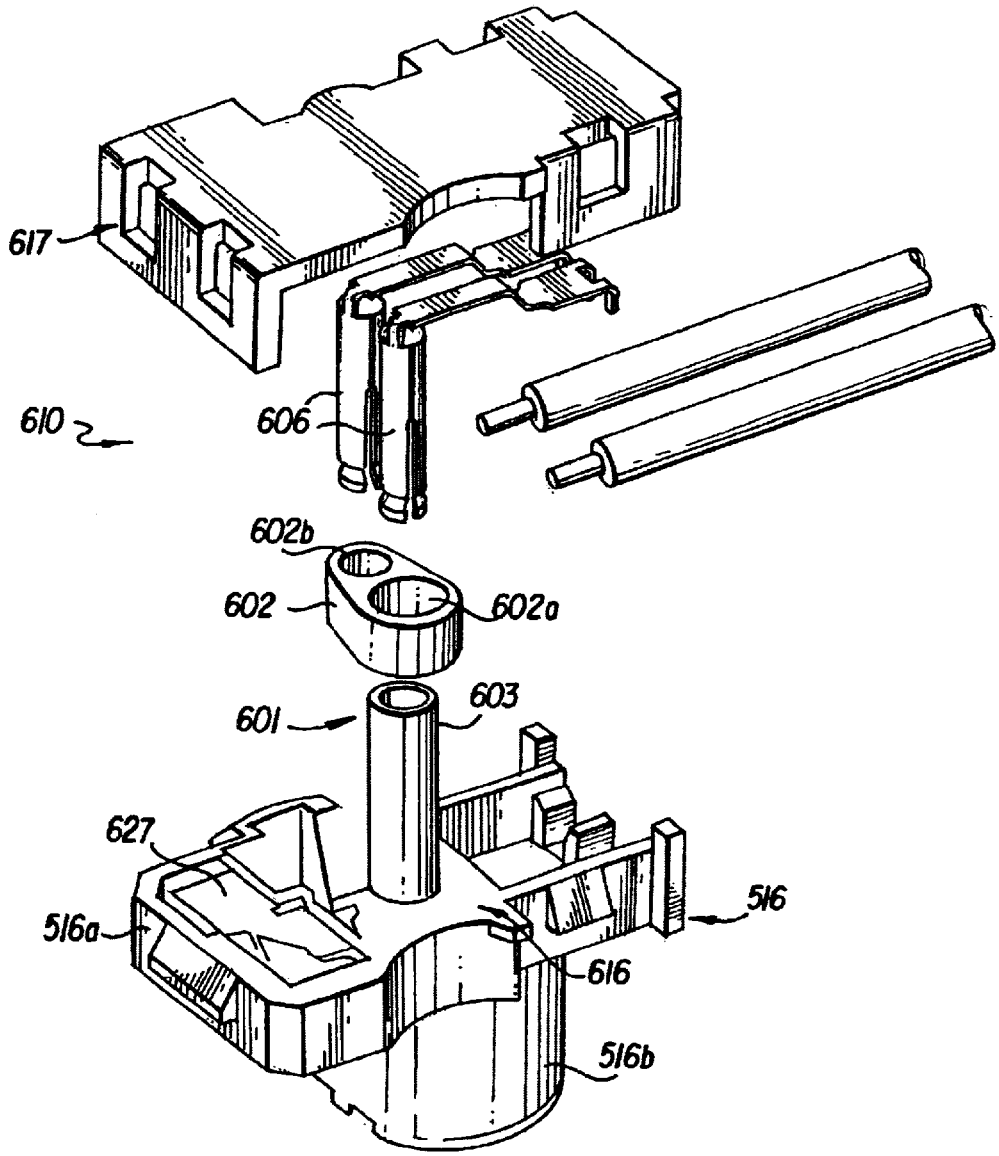

FIG. 10 is a perspective schematic view of an air bag connector including a spring back/self rejection feature;

FIG. 11 is a schematic perspective view of the air bag connector of FIG. 10 connected to an air bag initiator;

FIG. 12 is a side view of the combination of an air bag connector and air bag initiator in a state where the air bag connector is not properly connected and is rejected by the spring back/ self rejection feature of the connector housing;

FIG. 13 shows a variation of the air bag connector of FIGS. 5 and 6;

FIG. 14 is a schematic exploded perspective view of an alternative air bag connector; and FIG. 15 is another schematic exploded perspective view of the alternative air bag connector of FIG. 14.

DETAILED DESCRIPTION OF PREFERRED EMBODIMENTS

As used herein, the term "ferrite core" relates to a body or block of ferrite material having at least one opening therethrough. While the term "core" may imply the use of the ferrite body as a core for a coil, such coil may or may not be present, depending on desired filtering performance. In fact, in presently preferred embodiments of the invention, no coil is wound around the "ferrite cores".

Figure 1:
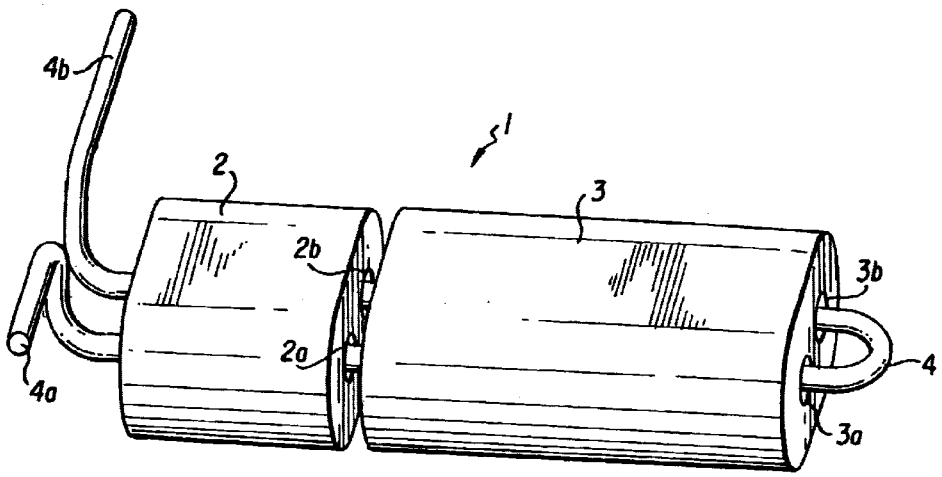
FIG. 1 is a perspective schematic view of a filter assembly including two multi-aperture ferrite cores.

FIG. 1 shows a filter assembly 1, in particular for EMI protection, including two multi-aperture ferrite cores 2 and 3. The first ferrite core 2 is of a generally cylindrical shape having a generally oval cross-section with two apertures 2*a*, 2*b* therein. The first ferrite core 2 is preferably made of a material with maximum performance in the higher frequency range of the targeted filter frequency range. The second ferrite core 3 is of a generally similar shape to the first ferrite core 2 and includes two apertures 3*a* and 3*b* therein. The second ferrite core 3 is preferably made of a material with maximum performance in the lower frequency range of the targeted filter frequency range. The respective lengths of the first and second ferrite cores 2 and 3 may be determined to in accordance with the desired performance. Moreover, the size and cross-sectional shape of the ferrite cores 2 and 3 may be chosen in accordance with the desired performance and available space.

Of course, it is possible to use more than just two ferrite cores. With spatial constraints permitting, a larger number of ferrite cores could be used. Also, within the same space, a larger number of smaller ferrite cores could be used. Length, overall size, and material of each ferrite core may be determined individually so as to tailor a desired filter performance in a particular frequency range of interest.

The apertures 2*a* and 3*a*, and the apertures 2*b* and 3*b*, respectively, in the ferrite cores 2 and 3 are aligned so as to form respective passages through both ferrite cores. It will be understood that, in principle, any plurality of apertures and passages may be used, even though it is presently preferred to use only two passages has shown in FIG. 1. A conductor 4 is looped through the passages formed in the ferrite cores 2 and 3. In particular, starting at one end 4*a* of the conductor 4, the conductor 4 is first guided through aperture 2*a* of ferrite core 2 and then through aperture 3*a* of ferrite core 3. At the end of aperture 3*a*, the conductor exits the ferrite core 3 and re-enters the same ferrite core 3 at aperture 3*b*. The conductor 4 is then guided through aperture 3*b* of ferrite core 3 and aperture 2*b* of ferrite core 2 where the conductor 4 exits ferrite core 2 at its other end 4*b*. By having at least two apertures in the ferrite cores and directing a signal through both (or more) of the apertures, the filtering performance of the ferrite cores is enhanced because the signal passes several times through the ferrite cores. Still, the multi-aperture ferrite cores need less space for the same filtering performance than a multiplicity of individual ferrite cores.

The conductor 4 may be made of insulated copper wire for conductive ferrite cores, or of solid copper wire for non-conductive ferrite cores. It will be understood that the conductor 4 may also be made of any other conductive material such as silver, gold etc., with the conductive material being insulated in case of conductive ferrite cores.

The two ends 4*a* and 4*b* are preferably bent twice by about 90 degrees, first in parallel to each other and then away from each other, so that the ends 4*a* and 4*b* are generally co-linear, but facing away from each other.

While the filter assembly as described above may be used in any environment and application, it is presently preferred to weld or solder the filter assembly to a frame. A filter frame sub-assembly 5 including the filter assembly 1 described above and a frame 6 is shown in FIGS. 2 and 3 of the drawings. The frame 6 is preferably made of a single piece of stamped and bent conductive sheet metal. The frame 6 has a planar main body of a general U-shape having legs 6*a* and 6*b*, with female contacting portions 6*c*, 6*d* being bent by 90 degrees and extending away from the distal ends of the legs 6*a*, 6*b*. It will be understood that the female contacting portions 6*c* and 6*d* could be replaced by male contacting portions, such as pins, without departing from the scope of the invention. The filter assembly 1 is placed transverse over the legs 6*a* and 6*b* of the frame 6, and the ends 4*a* and 4*b* of the conductor 4 are soldered, welded or otherwise conductively attached to one of the legs 6*a* of frame 6 at attachment points 7 and 8. Between the attachment points 7 and 8, frame 6 comprises a web 9 of reduced width or thickness which will be cut when the filter frame sub-assembly is mounted for use, e.g. in a connector, such as air bag connector 10 shown in FIG. 3. At the apex of the U-shape, frame 6 comprises another web 11 of reduced width or thickness which also will be cut when the filter frame sub-assembly is mounted for use. On both sides of web 11, frame 6 comprises cable contact areas 12 and 13 for soldering, welding, crimping or otherwise conductively attaching cables 14, 15 (see FIG. 3) for conducting a signal to be filtered by the filter assembly 1.

Figure 2:
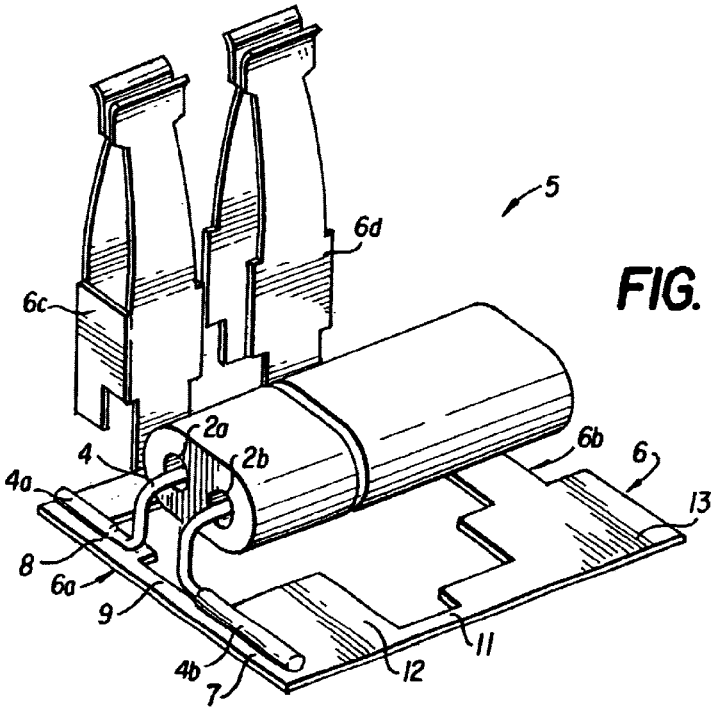
FIG. 2 is a perspective schematic view of the filter assembly of FIG. 1, mounted to a frame, in an intermediate state of assembly and forming a filter frame sub-assembly.
Figure 3:
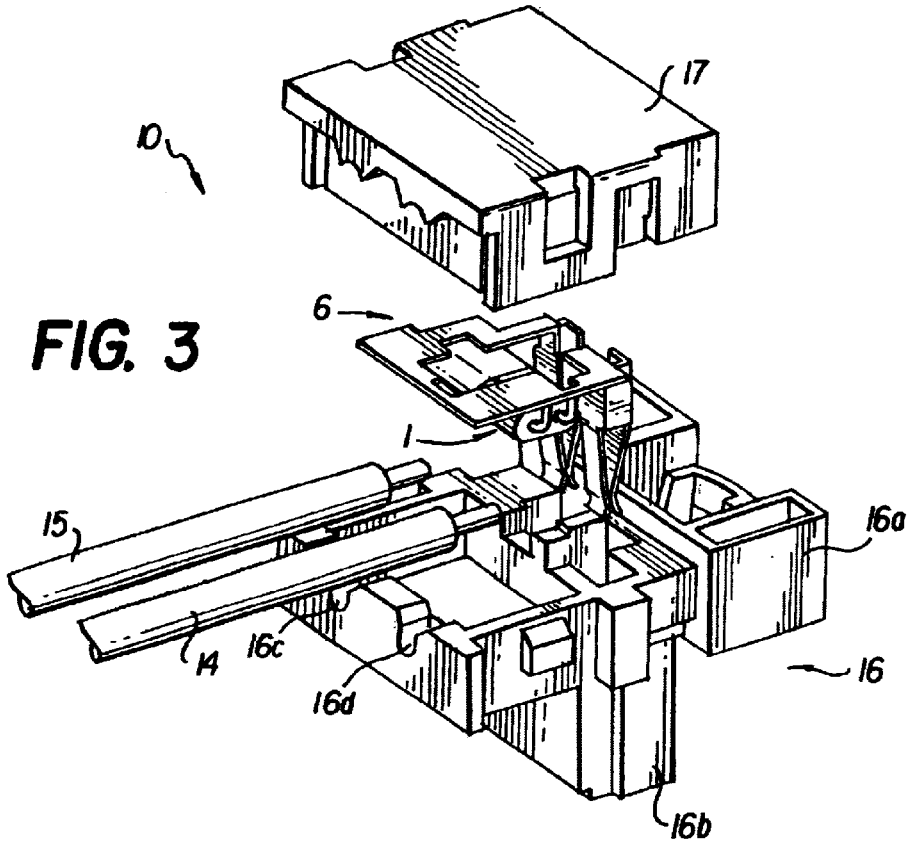
FIG. 3 is a schematic explosive view of an air bag connector including the filter frame sub-assembly of FIG. 2.

The filter frame sub-assembly 5 of FIG. 2 may advantageously be used in the minimized angled air bag connector 10 shown in FIG. 3. The air bag connector 10 comprises a connector housing 16 made of an electrically insulating material and having a main portion 16*a* and a nozzle or contact portion 16*b*. Two cables 14, 15 extend from the connector housing 16 through respective openings 16*c* and 16*d*. The ends of the cables 14, 15 are conductively attached to cable contact areas 12 and 13 of the frame 6. The contacting portions 6*c*, 6*d* of the frame 6 extend into openings formed in the contact portion 16*b* of the housing 16 for making contact with complementary contacting portions in a complementary socket to which the connector is to be attached.

A cover 17 made of an electrically insulating material is placed on the connector housing 16, covering the filter frame sub-assembly 5 in the connector housing 16. The cover 17 is snapped on the connector housing 16 or is attached thereto in any other suitable manner.

Figure 4:
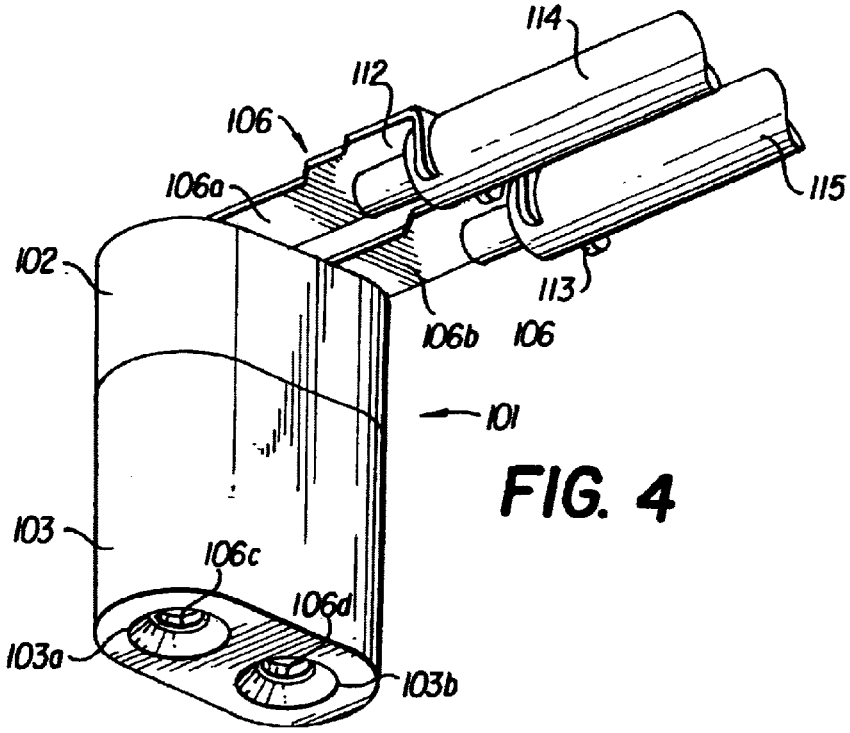
FIG. 4 is a perspective schematic view of another filter assembly including two multi-aperture ferrite cores juxtaposed to each other.

FIG. 4 is a perspective schematic view of another filter assembly 101 including two multi-aperture ferrite cores 102, 103 juxtaposed to each other. The ferrite cores 102 and 103 are generally similar to the ferrite cores 2 and 3 of FIG. 1. However, the apertures 102*a*, 102*b* and 103*a*, 103*b* of the ferrite cores 102 and 103 are larger in diameter than those of the ferrite cores 2 and 3, as will be explained hereinafter.

The first ferrite core 102 is of a generally cylindrical shape having a generally oval cross-section with two apertures 102*a*, 102*b* therein. The first ferrite core 102 is preferably made of a material with maximum performance in the higher frequency range of the targeted filter frequency range and is preferably nonconductive. The second ferrite core 103 is of a generally similar shape to the first ferrite core 102 and includes two apertures 103*a* and 103*b* therein. The second ferrite core 103 is preferably made of a material with maximum performance in the lower frequency range of the targeted filter frequency range and is preferably conductive. The respective lengths of the first and second ferrite cores 102 and 103 may be determined to in accordance with the desired performance. Moreover, the size and cross-sectional shape of the ferrite cores 102 and 103 may be chosen in accordance with the desired performance and available space.

Of course, it is possible to use more than just two ferrite cores. With spatial constraints permitting, a larger number of ferrite cores could be used. Also, within the same space, a larger number of smaller ferrite cores could be used. Length, overall size, and material of each ferrite core may be determined individually so as to tailor a desired filter performance in a particular frequency range of interest.

The apertures 102*a* and 103*a*, and the apertures 102*b* and 103*b*, respectively, in the ferrite cores 102 and 103 are aligned so as to form respective passages through both ferrite cores. It will be understood that, in principle, any plurality of apertures and passages may be used, even though it is presently preferred to use only two passages has shown in FIGS. 4 and 5.

As can be seen best in FIG. 5, the filter assembly 101 of FIG. 4 comprises two angled terminals 106, each comprising a leg 106*a*, 106*b* for making contact, e.g. with respective cables 114, 115, and a contacting portion 106*c*, 106*d*. It will be understood to that for the function of the filter assembly, the specific implementation of the angled terminals 106 is not essential; rather, all that is necessary to achieve the desired to filtering function, is a conductor for conducting a signal through the apertures of the ferrite cores 102 and 103 when the filter assembly is mounted and put into use.

The terminals 106 are preferably made of stamped and bent conductive sheet metal, either from a single piece or with the legs and contacting portions formed separately and being soldered, welded or otherwise conductively attached to each other.

In the preferred embodiment of FIGS. 4 and 5, the contacting portions 106*c* and 106*d* are female contacting portions. It will be understood that the female contacting portions 106*c* and 106*d* could be replaced by male contacting portions, such as pins, without departing from the scope of the invention. The legs 106*a*, 106*b* of the terminals 106 comprise cable contact areas 112 and 113 for soldering, welding, crimping or otherwise conductively attaching cables 114, 115 for conducting a signal to be filtered by the filter assembly 101.

The filter assembly 101 of FIG. 4 may advantageously be used in the minimized angled air bag connector 110 shown in FIGS. 5 and 6. The air bag connector 110 comprises a connector housing 116 made of an electrically insulating material and having a main portion 116*a* and a nozzle or contact portion 116*b*. Two cables 114, 115 extend from the connector housing 116 through respective openings 116*c* and 1 16*d*. The ends of the cables 114, 115 are conductively attached to the cable contact areas 112 and 113 of the terminals 106. The female contacting portions 106*c*, 106*d* of the terminals 106 together with the ferrite cores 102, 103 extend into an opening 118 formed in the contact portion 116*b* of the housing 116 for making contact with complementary contacting portions in a complementary socket to which the connector is to be attached. The contact portion 116*b* of the housing 116 is formed such that the female contacting portions 106*c*, 106*d* of the terminals 106 together with the ferrite cores 102, 103 may be placed therein with the ferrite cores 102, 103 being retained within the contact portion 116*b* of the housing 116 while allowing access to the female contacting portions 106*c*, 106*d* of the terminals 106. Preferably, the opening 118 in the contact portion 116*b* of the housing 116 is closed at the bottom, with two smaller openings 118*a*, 118*b* being formed for access to the female contacting portions 106*c*, 106*d*.

A cover 117 made of an electrically insulating material is placed on the connector housing 116, covering the filter assembly 101 in the connector housing 116. The cover 117 is snapped on the connector housing 116 or is attached thereto in any other suitable manner. The cover 117 may be equipped with a static discharge feature to be described hereinafter.

In order to avoid accidental deployment of an air bag device by static discharge from an operator handling the connector and connecting the connector to an initiator of the air bag device, the connector may be provided with a novel static discharge feature. Therein, a static charge may be discharged from an operator through the connector into a harness to which the air bag connector 110 is connected via the cables 114, 115 while handling the connector and before mating the connector with a socket of the air bag device.

In particular, the cover 117 has a substantially planar main portion 117*a*. An opening 119 is formed in the main portion 117*a* at a position overlying one of the terminals 106 when the air bag connector 110 is assembled. The cover 117 further comprises a conductive insert 117*b*. Preferably, the conductive insert 117*b* extends across the width of the cover 117. At least a portion of the conductive insert 117*b* is exposed to the outside when the air bag connector 110 is assembled. In the preferred embodiment shown in FIGS. 5 and 6, the conductive insert 117*b* comprises tabs 120, 121 on both ends thereof. The tabs 120,121 are positioned on the connector such that the tabs come into contact with the fingers of a user grasping the connector. Any static charge from the user will be conducted via the tabs 120, 121 to the conductive insert 117*b*. An air gap is formed in the opening 119 between the conductive insert 117*b* and the leg 106*a* of terminal 106. The air gap is adjusted to an appropriate width so as to allow discharge of a certain voltage differential, e.g. 500 VDC, without causing the terminal-to-terminal resistance in the connector to drop below 1 MΩ. Accordingly, any static charge is discharged from the operator through the conductive insert and via the air gap to the terminal 106 and into the harness connected to cables 114, 115 before the connector is connected to an initiator of an air bag, thus eliminating the danger of inadvertent deployment of the air bag device during assembly.

FIG. 7 shows an alternative filter assembly 201, generally similar to the filter assembly 101 of FIG. 4, including two concentrically arranged ferrite cores 202, 203 for combined differential and common mode filtering. Ferrite core 202 is generally similar to either of ferrite cores 102 and 103 of FIGS. 4 and 5 and will therefore not be further described. Also, the angled terminals 206 and the cables 214, 215 connected to the terminals 106 are generally similar or identical to the terminals 106 and the cables 114, 115 of FIGS. 4 and 5, and will not be further described. Different from the embodiment of FIGS. 4 and 5, the second or outer ferrite core 203 has the form of a sleeve fitting around the first or inner ferrite core 202. In an assembled condition, the ferrite cores 202, 203 are concentrically arranged.

The first ferrite core 202 is of a generally cylindrical shape having a generally oval cross-section with two apertures 202*a*, 202*b* therein. The first ferrite core 202 is preferably made of a first material with maximum performance in the differential mode of the signal to be filtered. The second ferrite core 203 is of a generally sleeve-type shape surrounding the first ferrite core 202. The second ferrite core 203 is preferably made of a second material with maximum performance in the common mode of the signal to be filtered. The respective lengths of the first and second ferrite cores 202 and 203 may be determined to in accordance with the desired performance. Moreover, the size and cross-sectional shape of the ferrite cores 202 and 203 may be chosen in accordance with the desired performance and available space.

Of course, it is possible to use more than just two ferrite cores. With spatial constraints permitting, a larger number of ferrite cores could be used. Also, within the same space, a larger number of smaller ferrite cores could be used. Length, overall size, and material of each ferrite core may be determined individually so as to tailor a desired filter performance in a particular frequency range of interest. For example, instead of one inner multi-aperture ferrite core 202, two or more such cores could be used in a juxtaposed fashion with the outer sleeve-type ferrite core 203 covering part or all of the inner cores. As another example, instead of one outer sleeve-type ferrite core 203, two or more such cores could be used in a juxtaposed fashion covering part or all of the inner core(s).

It will be noted that the multi-aperture ferrite cores 102 and 103 of the filter assembly 1 shown in FIGS. 1–3 are most effective for differential mode filtering. For improving common mode filtering, the ferrite cores of the embodiment of FIGS. 1–3 could be arranged concentrically similar to those shown in FIGS. 6 and 7, or one or more additional sleeve-type ferrite cores could be placed around the cores 102 and 103.

Figure 8:
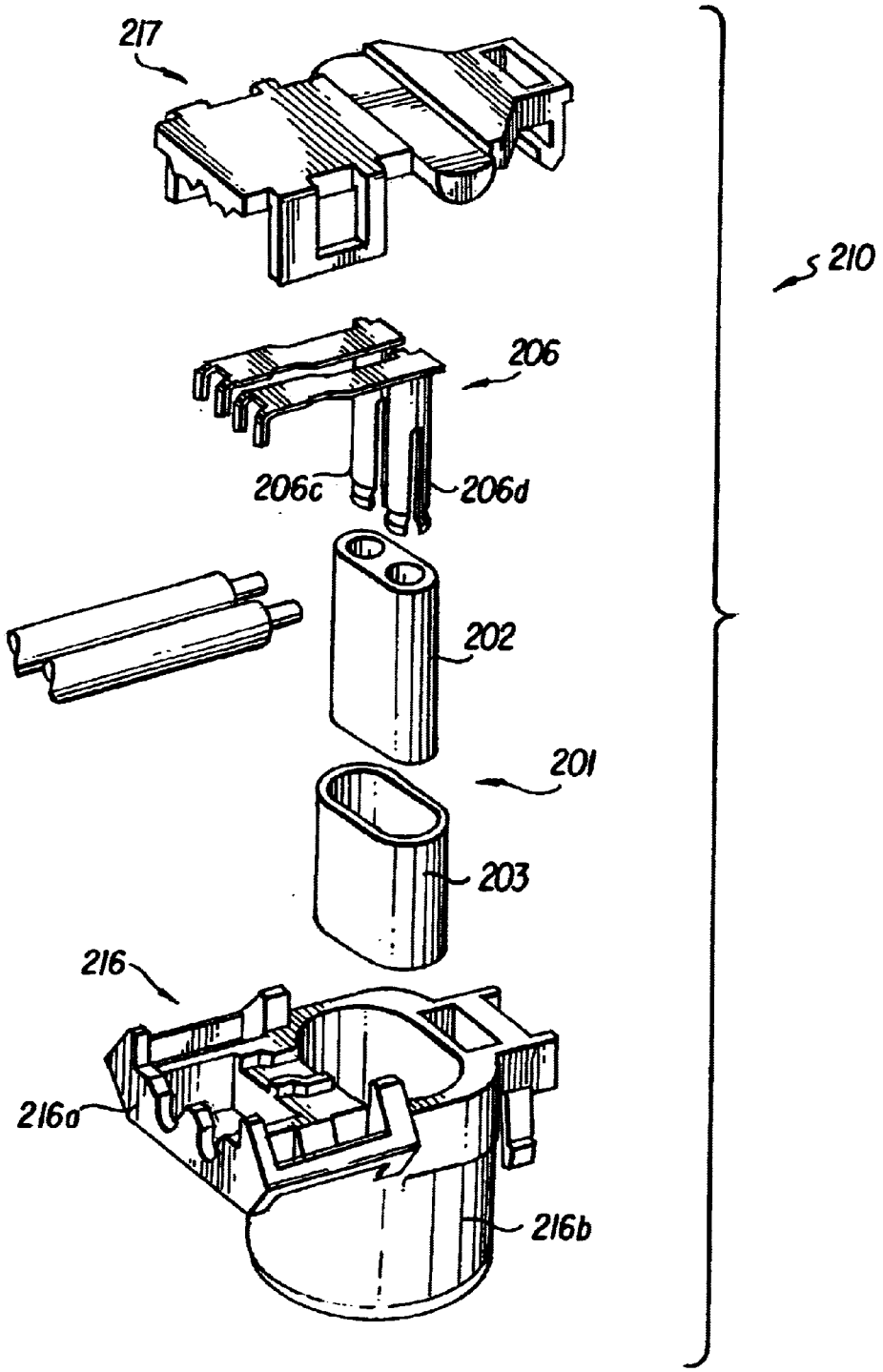
FIG. 8 is a schematic explosive view of an air bag connector including the filter assembly of FIG. 7.

The filter assembly 201 of FIG. 7 may advantageously be used in the minimized angled air bag connector 210 shown in FIG. 8. The air bag connector 210 is generally similar to the air bag connector 110 shown in FIG. 5 and will therefore not be described in detail. The air bag connector 210 comprises a housing 216 having a main portion 216*a* and a nozzle or contact portion 216*b*. The contact portion 216*b* of the housing 216 is formed such that the female contacting portions 206*c*, 206*d* of the terminals 206 together with the concentrically arranged ferrite cores 202, 203 may be placed therein with the ferrite cores 202, 203 being retained within the contact portion 216*b* of the housing 216 while allowing access to the female contacting portions 206*c*, 206*d* of the terminals 206. Preferably, the opening in the contact portion 216*b* of the housing 216 is closed at the bottom, with two smaller openings being formed for access to the female contacting portions 206*c*, 206*d*.

A cover 217 is placed on the connector housing 216, covering the filter assembly 201 in the connector housing 216. The cover 217 is snapped on the connector housing 216 or is attached thereto in any other suitable manner. The cover 217 may be equipped with the static discharge feature described above in connection with the embodiment of FIGS. 5 and 6.

FIG. 9 shows the terminals of the filter assemblies of FIGS. 4–8 and illustrate the terminal/cable interface with (partial) IDC (insulation displacement connection) used as insulation strain relief. The following description will be made with respect to terminals 306 which could be identical to the terminals 106 of the embodiment of FIGS. 4–6 or to the terminals 206 of FIGS. 7 and 8.

The terminals 306 are angled, each comprising a leg 306*a*, 306*b* for making contact, e.g. with respective cables (only one cable 314 being shown in FIG. 9) and a contacting portion 306*c*, 306*d*.

The terminals 306 are preferably made of stamped and bent conductive sheet metal, either from a single piece or with the legs and contacting portions formed separately and being soldered, welded or otherwise conductively attached to each other.

In the preferred embodiment shown, the contacting portions 306*c* and 306*d* are female contacting portions. It will be understood that the female contacting portions 306*c* and 306*d* could be replaced by male contacting portions, such as pins, without departing from the scope of the invention. The legs 306*a*, 306*b* of the terminals 306 comprise cable contact areas 312 and 313 for soldering, welding, crimping or otherwise conductively attaching cables for conducting a signal to be filtered by the filter assembly (not shown in FIG. 9).

The cables comprise an inner conductor 322 and an outer insulation 323. At the outer end of the cable 314, the inner conductor 322 is exposed and extends beyond the outer insulation 323. The exposed end of the inner conductor 322 is soldered or welded to the cable contact area 312 of the terminal 306, but could equally be crimped or otherwise conductively attached to terminal 306.

The distal end of the leg 306*a* of terminal 306 is forked and the forked ends are bent by about 90°. The spacing between the forked ends of leg 306*a* is larger than the diameter of the inner conductor 322, but smaller than the outer diameter of the insulation 323. When the cable 314 is attached to the terminal 306, the cable 314 is pressed with its insulation 323 between the bent forked ends of leg 306*a*. Preferably, the forked ends of leg 306*a* cut into the insulation 323 in order to provide positive locking of the insulation against movement in an axial direction of the cable 314. The edges of the forked ends facing to each other may be sharp so as to facilitate cutting into the insulation 323. For applications where smaller pulling forces on the insulation are expected, it may be sufficient to press the insulation between the forked ends of the terminal in an interference fit without cutting.

Partial IDC maintains a good integrity of the insulation and the conductor and provides better resistance against pulling off the insulation from the conductor in an axial direction of the cable 314 while avoiding weakening of the cable by partially cutting the conductor 322 as would be the case for total (or conventional) IDC. However, for certain applications, it may be possible to use total (or conventional) IDC techniques since the conductor 322 is to be connected with the terminal 306 anyway (such as by soldering or welding of the exposed distal end of conductor 322 to a cable contact portion 312, 313 of terminal 306), i.e. the insulation 323 may be cut all the way through to the conductor 322 by the forked ends of the terminal 306.

Next, a novel spring back/self rejection feature for a connector is explained primarily in connection with FIGS. 10–12. While the example shown in these figures is an air bag connector as shown in FIGS. 5 and 6 connected to an air bag initiator, the spring back/self rejection feature may be applied to any type of connector, angled or straight, to clearly distinguish between states of proper mating or connection and improper connection.

In FIG. 10, an angled connector 410 is shown with the cover being omitted. A connector housing 416 comprises a main portion 416*a* and a nozzle or contact portion 416*b*. The main portion 416*a* comprises stops or abutment surfaces 424, 425 limiting the distance or amount of insertion of the contact portion 416*b* into a mating socket such as an air bag initiator 426 shown in FIG. 11. In the connector shown in FIG. 10, the lower surface 424 of the main portion 416*a* serves as a first stop. As may be seen best in FIGS. 6, 11 and 12, a second stop or abutment 425 is formed on the main portion 416*a* opposite to the first stop 424 with respect to the contact portion 416*b*.

In the embodiment of FIGS. 10–12, there are three spring arms 427, 428, 429 formed integrally with the connector housing 416. For example, the connector housing 416 including the spring arms 427, 428, 428 could be formed by plastic injection molding. The first spring arm 427 is disposed on a rear end side of the connector, whereas the second and third spring arms 428, 429 are disposed on a front end side of the connector. The first spring arm 427 is disposed generally centrally with regard to a longitudinal central axis of the connector main portion 416, whereas the second and third spring arms 428, 429 are arranged to extend generally away from the longitudinal central axis of the connector main portion 416. Thus, the free ends of the spring arms 427, 428, 429 are arranged about the contact portion of the connector such that they form approximately an isoceles triangle in order to apply a force in a direction opposite to the direction of insertion of the connector into the socket, regularly distributed about the circumference of the contact portion of the connector so as to avoid tilting and skewing of the connector. Generally speaking, the spring arms should be arranged about the contact portion of the connector to extend substantially tangentially thereto so as to occupy as little space as possible.

The combination of connector and socket comprises a locking means for locking the connector to the socket when the connector is fully inserted and properly connected to the socket. In the embodiment shown in FIGS. 5–6 and 10–12, the locking feature is implemented as a locking arm 431 formed on the contact portion 416*b* of the connector. The locking arm 431 is a spring arm attached to the contact portion 416*b* near the outer end thereof and extending in a direction opposite to the direction of insertion of the connector into the socket and generally parallel to a circumferential surface of the contact portion 416*b*. The length of the locking arm 431 is preferably less than the length of the contact portion 416*b*. The free end of the locking arm 431 is preferably flared so as to provide a kind of ratchet. However, it will be understood that the locking arm 431 could be implemented without the flared end and still provide the locking function in combination with a corresponding groove and/or shoulder on the socket.

A recess or shoulder (not shown) is provided on the socket at a location where the free end of the locking arm 431 can come into locking engagement therewith when the connector 410 is fully inserted into the socket, thus locking the connector 410 in an end position within the socket.

When the air bag connector 410 is being connected with an air bag initiator 426, the contact portion 416*b* of the connector is inserted into a complementary socket (not shown in the drawings) in the air bag initiator 426. Before the contact portion 416*b* is fully inserted into the socket, the spring arms 427, 428, 429 engage a stop surface 432 formed on the air bag initiator 426, as shown in FIGS. 11 and 12. Continued insertion movement of the connector 410 into the socket will deflect the spring arms 427, 428, 429 causing an increasing reaction force until the end position is reached in which the abutment surfaces 424, 425 of the connector 410 contact the stop surface 432 of the initiator 426. In the end position, the locking arm 431 engages the shoulder in the socket locking the connector in the socket. If the end position is not reached, the spring arms 427, 428, 429 will move the connector back to the position of FIGS. 11 and 12, thus indicating clearly that no proper connection was made between the connector 410 and the socket.

Many of the features described in the foregoing description may be used individually or combined in a single device. For example, the various filter assemblies disclosed in context with FIGS. 1–8 may be used individually in any EMI filter application, or, for example, together with the static discharge feature described in connection with FIGS. 5 and 6 and/or with the insulation strain relief feature described in connection with FIG. 9 and/or with the spring back/self rejection feature described in connection with FIGS. 10–12. Moreover, the static discharge feature described in connection with FIGS. 5 and 6, the insulation strain relief feature described in connection with FIG. 9, and the spring back/self rejection feature described in connection with FIGS. 10–12 may each be used, individually or in any combination, on connectors other than the EMI filtered air bag connector described herein.

In FIGS. 13–15, variations of some of the features described above are illustrated. The air bag connectors shown in FIGS. 13–15 also show some additional features not shown or described above.

In particular, taking reference to the embodiment shown in FIG. 13, an air bag connector 510 comprises a filter assembly 501 similar to the filter assembly 101 of FIGS. 4–6. Preferably, a first ferrite core 502 is made of a non-conductive ferrite material, whereas an aligned second ferrite core 503 is made of a conductive ferrite material. In order to isolate the conductive ferrite core 503 from the terminal extending therethrough, the connector housing 516 comprises an integral molded wall 540, of a generally cylindrical or tubular shape, which fits into one of the openings 503*a* of the multiaperture conductive ferrite core 503. The wall 540 may also extend into an aligned opening 502*a* of the other, non-conductive ferrite core 502.

The air bag connector 510 of FIG. 13 also comprises the static discharge feature in the cover 517 and the self rejection feature, both features having been described in detail above. However, in this embodiment, the two features are combined in one single element 517*b*. The element 517*b* may preferably be made of stamped and bent sheet metal. The element 517*b* overlies and spans the width of the cover 517 and forms tabs 520, 521 for making contact with an operator grasping the air bag connector for handling thereof, e.g. during a connection process of the air bag connector with an associated socket. The tabs 520, 521 may reach around side edges of a main portion 516*a* of the connector housing 516 and may assist in attaching the cover 517 to the connector housing 516. Two curved spring arms 527, 528 are formed integrally with the element 517*b*. The spring arms 527, 528 form a semi-circle and extend through cut-outs 516*e*, 516*f* in the connector housing 516 beyond a lower abutment surface of the connector housing main portion. When the air bag connector 510 is to be connected with a complementary socket (not shown), the spring arms 527, 528 will provide a self-rejection feature, pushing the air bag connector 510 away from a connected state, if the connector and the socket are not properly connected and locked in a connected state.

FIGS. 14 and 15 show an alternative air bag connector 610 having a different filter arrangement 601 and an alternative self-rejection spring 627. The filter arrangement 601 comprises a first cylindrical ferrite core 602, preferably made of an electrically non-conducting material, and a second multi-aperture ferrite core 603, preferably made of an electrically conducting material. The opening of the first ferrite core 602 is dimensioned to receive one of the terminals 606. One opening 603*a* of the second multi-aperture ferrite core 603 is sized to receive the first ferrite core 602 therein, whereas another opening 603*b* of the second multi-aperture ferrite core 603 is sized to receive therein the other one of the terminals 606. The connector housing 616 is formed to preferably snugly receive both ferrite cores 602 and 603.

The self-rejection spring 627 is generally U-shaped and may be made of stamped and bent sheet metal. One leg of the U-shaped self-rejection spring 627 comprises means for attachment with the connector housing 616. Preferably, the self-rejection spring 627 comprises tabs 627*a*, 627*b* which are clamped between the connector housing 616 and the cover 617 in the assembled state. The other leg of the self-rejection spring 627 is free to extend through an opening formed in the connector housing 616 beyond a lower abutment surface of the connector housing main portion. When the air bag connector 610 is to be connected with a complementary socket (not shown), the spring 627 will provide a self-rejection feature, pushing the air bag connector 610 away from a connected state, if the connector and the socket are not properly connected and locked in a connected state.

In view of the foregoing description, a skilled person will recognize further modifications, objects and advantages of the present invention without departing from the scope of the appended claims.

What is claimed is:

1. A filter assembly for filtering electrical signals comprising:

at least two ferrite bodies; wherein at least two of the ferrite bodies are made of different ferrite materials, at least two of the ferrite bodies are of generally different sizes, and each ferrite body comprises at least one passage with an electrical conductor passing through said passage.

2. Filter assembly according to claim 1 comprising two ferrite bodies, each having two passages therein.

3. Filter assembly according to claim 2 wherein said ferrite bodies are of a generally cylindrical shape having a generally oval cross-section.

4. Filter assembly according to claim 3 wherein said ferrite bodies are positioned adjacent to each other and said passages in said ferrite bodies are aligned in pairs.

5. Filter assembly according to claim 4 wherein said passages are parallel to each other.

6. Filter assembly according to claim 5 wherein said electrical conductor is passed through a first pair of said passages in a first direction and then through a second pair of said passages in a second direction opposite to said first direction.

7. Filter assembly according to claim 1 wherein said ferrite bodies are made of materials with different filter performance.

8. Filtered electrical connector, comprising:

a connector housing made of an electrically insulating material;

at least two terminals each having a cable contact area for conductively attaching cables for conducting a signal to be filtered and a contacting portion for making contact with a corresponding contacting portion in a complementary mating connector; and a filter assembly, comprising an electrical conductor for conducting an electrical signal to be filtered and at least two ferrite bodies, each of the ferrite bodies comprising at least two passages therein with the electrical conductor passing through said passages, with respective ends of the electrical connector being connected in series between one of the cable contact areas and an associated contacting portion.

9. Filtered electrical connector according to claim 8, further comprising a frame made of electrically conductive material, said frame forming said at least two terminals.

10. Filtered electrical connector according to claim 8, wherein said filter assembly comprises two ferrite bodies, each having two passages therein.

11. Filtered electrical connector according to claim 10, wherein said ferrite bodies are of a generally cylindrical shape having a generally oval cross-section.

12. Filtered electrical connector according to claim 11, wherein said ferrite bodies are positioned adjacent to each other and said passages in said ferrite bodies are aligned in pairs, wherein said passages are parallel to each other, and wherein said electrical conductor is passed through a first pair of said passages in a first direction and then through a second pair of said passages in a second direction opposite to said first direction.

13. Filtered electrical connector according to claim 8, wherein said ferrite bodies are different in size.

14. Filtered electrical connector according to claim 8, wherein said ferrite bodies are made of materials with different filter performance.

15. Filtered electrical connector according to claim 8, wherein the electrical connector is an angled air bag connector.

* * * * *